US006176609B1

(12) United States Patent
Cleveland et al.

(10) Patent No.: US 6,176,609 B1
(45) Date of Patent: Jan. 23, 2001

(54) MAGNETIC TUMBLE STIRRING METHOD, DEVICES AND MACHINES FOR MIXING IN VESSELS

(75) Inventors: Patrick H. Cleveland; John R. Markle, both of San Diego, CA (US)

(73) Assignee: V & P Scientific, Inc., San Diego, CA (US)

( * ) Notice: Under 35 U.S.C. 154(b), the term of this patent shall be extended for 0 days.

(21) Appl. No.: 09/170,459

(22) Filed: Oct. 13, 1998

(51) Int. Cl.[7] ..... B01F 13/08
(52) U.S. Cl. ..... 366/273; 422/102; 435/288.4
(58) Field of Search ..... 366/273, 274; 422/102; 435/288.4

(56) References Cited

U.S. PATENT DOCUMENTS

| | | | | |
|---|---|---|---|---|
| 3,356,346 | * | 12/1967 | Landsberger | 366/274 |
| 4,140,401 | * | 2/1979 | Paschal | 366/274 |
| 4,227,815 | * | 10/1980 | Hoffa | 366/273 |
| 4,568,195 | * | 2/1986 | Herz et al. | 366/274 |
| 5,529,391 | * | 6/1996 | Kindman et al. | 366/274 |
| 5,558,839 | * | 9/1996 | Matte et al. | 366/274 |
| 5,578,201 | * | 11/1996 | Collier et al. | 366/273 |
| 5,779,907 | * | 7/1998 | Yu | 210/695 |
| 5,899,567 | * | 5/1999 | Morris, Jr. | 366/274 |

FOREIGN PATENT DOCUMENTS

| | | | | |
|---|---|---|---|---|
| 3344754A1 | * | 6/1985 | (DE) | 366/273 |
| 1500356 A1 | * | 8/1989 | (SU) . | |

* cited by examiner

*Primary Examiner*—Robert Popovics
(74) *Attorney, Agent, or Firm*—Edward W. Callan

(57) ABSTRACT

The invention provides a simple method, device and several machines for simultaneously stirring thousands of vessels or wells of microplates in a robust manner and with economy. This method uses the simple principle of magnetic stirrers aligning themselves to a vertical driving magnetic field placed beneath them and moving laterally or by moving the vessels over a stationary magnetic field or by spinning the drive magnets, or by using a modulating/reversing electromagnetic field to produce the moving effect. Each vessel contains a magnetic disc, bar, dowel or other shape (stirrers) which in it's magnetic attraction to the vertical driving magnetic field will cause it to move and align it's magnetic field as the opposite poles of the drive magnet and the stirrer attract each other. The attraction of the stirrers to the vertical driving magnetic field causes the stirrers to stand on end and tumble as the stir devices try to align to the opposite moving magnetic pole. The stirrers tumble because the walls of the vessels or friction with the vessel bottom prevents their lateral movement.

12 Claims, 8 Drawing Sheets

S
N
10
13
15
20
21
23
24

MAGNETIC TUMBLE STIRRING METHOD, DEVICES AND MACHINES FOR MIXING IN VESSELS

BACKGROUND

1. Field of Invention

This invention provides a method, devices and machines to uniformly and simultaneously mix in vessels. The purpose is to provide a robust method, economical devices and very simple machines to uniformly stir the contents of one vessel or thousands of vessels or microplate wells (6 well, 12 well, 24 well, 48 well, 96 well, 384 well, 864 well, 1536 well, 10,000 well and the deep well, "U" bottom, "V" bottom, PCR and other versions of those microplates) at the same time.

2. Description of Prior Art

Suspending particulates in liquids, breaking up aggregates, aeration of gases in liquids, dissolving solids in liquids, emulsifying two liquids or mixing liquids together has usually been accomplished in large vessels, bottles, flasks and test tubes by magnetic horizontal spin stirring, orbital shakers, vortexing, rocking platforms, bubblers or vibrators. In an effort to miniaturize many of the operations that were done in bottles, flasks and test tubes, scientists have shifted to multi well microplates (6, 12, 24, 48, 48 deep well, 96, 96 deep well, 384, 864, 1536 and 10,000 wells/microplate). Microplates are now commonly used in a wide variety of scientific applications to act as mini-reaction vessels for liquid assays. However because of the combination of the small well diameter, the tall height of the column of liquid and the significant attraction of liquid surface tension forces to the walls of small diameter wells (especially in the 48, 96, 384, 864, 1536 and 10,000 well microplates) it is not possible to adequately resuspend particulates, stimulate the growth of microorganisms, break up aggregates, break open cells, aerate gases in to liquids, emulsify two liquids, mix two liquid reagents, or to dissolve a solid in a liquid by simple agitation on an orbital shaker, vortexer, rocker platform, bubbler or by vibration without generating a force so violent that it would throw the liquids out of the miniature vessels. Magnetic horizontal spin stirring has been adapted to 96 well microplates by VARIOMAG-USA. They put spinning permanent magnet stirrers into the wells of a 96 well microplate and place the 96 well microplate on a magnetic stirring system with an individual modulated (driving) electromagnetic stir point engineered under the center of each well. The placement of the wells exactly over a stir point is critical so the spinning stirrers don't hit the well walls and lose synchronization with the driving electromagnetic field, causing them to vibrate in the wells. If they hit the well wall the whole stirrer has to be stopped repositioned and slowly started spinning again. Often when the stir point system is rapidly spinning, the stir magnets in individual wells get out of synchronization with the driving electromagnetic field for no apparent reason or due to the vibration of the stirring action moving the plate. Part of this sensitivity phenomena is due to the physics of the interaction of the magnetic fields of the driving electromagnet and the spinning magnetic stirrer which line up parallel to each other, thus resulting in a weaker magnetic coupling than if the poles were directly opposed to each other. This weak magnetic coupling also is demonstrated if there is a differential viscosity between the liquids of different wells of the same microplate, as this will slow the stirrers in those wells and throw those magnetic stirrers out of sync. The cost of this magnetic stir point system is $2,400.00 for each 96 well plate and the cost of the individual stirring magnets for each well is $2.45 thus bringing the total cost to stir each plate to $2,635.00. Furthermore a unique stir point configuration (6, 12, 24, 48, 96, 384, 1536, and 10000 wells) is required for each well configuration of the microplate well format used. Because of these technical and cost considerations this system has not been widely used. Another way to provide adequate mixing in microplates is by pipetting the contents of each well up and down. This can be done manually or by robotic work stations. There are several robotic work stations that will do this pipet mixing operation but they will just mix 4 to 12 wells at a time and the pipets must be washed or changed between wells. Recently Robbins Scientific introduced the "Hydra" work station which will pipet and mix 96 wells at a time but it costs ~$30,000 and is still laborious as the pipets must be washed between wells. Furthermore it would be economically impossible to do continuous mixing of multiple microplates simultaneously by pipetting. In addition it would be difficult to place a large robotic workstation in an incubator if microorganisms were the objects being mixed while culturing. Thus the miniaturization of continuous mixing processes on a large number of microplates remains impractical up til now.

SUMMARY OF THE INVENTION

Objects and Advantages

The present invention provides a method of mixing the contents of each of a two-dimensional array of vessels, each vessel having a vertical axis as defined when the vessel is disposed for the mixing of said contents, the method comprising the steps of:

(a) placing magnetic stirrers within said vessels; and (b) when the vessels are disposed for the mixing of said contents, rotating a permanent magnet about a non-vertical axis of rotation that is so disposed adjacent the array that said rotation of the magnet provides magnetic flux lines that rotate through 360 degrees within a non-horizontal plane within each of the vessels to thereby cause the magnetic stirrers therein to tumble in at least one direction that is other than about the vertical axis of each vessel;

whereby the contents of each vessel containing a said magnetic stirrer are mixed by the tumbling of said magnetic stirrer.

The present invention also provides a system for mixing the contents of each of a two-dimensional array of vessels, each vessel having a vertical axis as defined when the vessel is disposed for the mixing of said contents, the system comprising: means for receiving an array of vessels in a disposition for the mixing of said contents; a permanent magnet disposed in relation to the receiving means for rotation about a non-vertical axis of rotation that is so disposed adjacent the array that said rotation of the magnet provides magnetic flux lines that rotate through 360 degrees within a non-horizontal plane within each of the vessels to thereby cause magnetic stirrers therein to tumble in at least one direction that is other than about the vertical axis of each vessel; and means for so rotating the permanent magnet; whereby the contents of each vessel containing a said magnetic stirrer are mixed by the tumbling of said magnetic stirrer.

Thus it is the object of the method, devices and machines to provide a very simple process of uniformly mixing the contents of thousands of vessels and microplate wells (6 well, 12 well, 24 well, 48 well, 48 deep well, 96 well, 384 well, 864 well, 1536 well, 10,000 well and the deep well, "U" bottom, "V" bottom, PCR and other versions of those microplates) at the same time. We have made stainless steel magnetic stir discs, bars and dowels of different dimensions, shapes and with magnetic field orientations through the long axis so that they will fit into any vessel and provide a vigorous stirring action when they are tumbled end over end through the long axis in a vertical magnetic field(s). By making the magnetic stirrers nearly the same diameter or length as the diameter of the vessel they are stirring or by putting multiple magnetic stirrers into a single vessel a very significant stirring action is effected when they tumble through the magnetic axis. We have discovered that while stainless steel is commonly thought to be non-magnetic, several stainless steels that have been "hardened", "spring tempered" or "cold worked" are magnetic. Because stainless steel is corrosion resistant, it maybe used as a magnetic stirrer without any protective coating like teflon thus making stainless steel magnetic stirrers very inexpensive.

Magnetic tumbling or stirring in the vertical plane is produced by the magnetic poles of stirrers inside vessels being attracted to an opposite vertically oriented drive magnetic field produced by a permanent magnet or an electromagnet under the vessel. This vertical magnetic attraction causes the stirrers to stand on a polar end and then fall when either the drive magnetic field or the vessels are moved laterally in respect to each other and the stirrer can not maintain the vertical orientation because of the wall of the vessel or friction with the well bottom. Moving the stirrer can also be produced by orientation of neighboring opposite magnetic fields, spinning the drive magnetic field instead of laterally moving it, or reversing the magnetic field by reversing the polarity of an electromagnetic field or by turning off and on an electromagnetic field and again producing a "tumbling action".

Magnetic tumbling has the advantage of greater magnetic coupling between the drive magnet and the stirring magnet than parallel magnetic coupling used in typical spinning magnetic stirrers because the magnetic fields are strongest in direct opposition. In magnetic tumble stirring the plane of the magnetic field of the drive magnets are positioned vertically to enhance the strength of attraction of the opposite magnetic field of the magnetic stirrer by direct alignment of opposing magnetic poles.

It is also the object of the machines, device and method to provide a robust, economical and practical mixing method to resuspend particulates, to dissolve a solid in a liquid, to mix two or more liquid reagents, to emulsify two or more liquids, to break up aggregates, break up filamentous organisms, stimulate the growth of microorganisms, break open cells, mix and immobilize magnetic beads or to aerate gases into liquids in vessels or microplate wells. The positive physical displacement of the liquid and particles by the tumbling action of the stirrer produces a robust mixing or movement of the liquids and solids in the well. In the case where extracts are dried in the bottom of wells to be later suspended, the direct physical contact between the stirrer and the extract is often critical in the dissolving of the extract. Physical contact is also important in mixing oil and water to make an emulsion. This direct physical contact cannot be duplicated by orbital shaking, vortexing, rocker platform or vibration. Furthermore the power of the tumbling action is such that it will stir even viscous material like pure glycerol, aggregates, emulsions and heavy suspensions of particulates that can not be stirred by the electronic stirring point system of the Variomag.

The High Volume version of the invention uses a massive driving magnet that is moved laterally under the reaction vessels or wells which contain magnetic stirrers. One of the advantages of this version is that massive vertically oriented magnets project magnetic lines of force (flux) over great distances. The lines of magnetic force tend to bend back to the opposite pole and those near the edge of the magnet are bent the most and rise to the least vertical height. While those in the center of the magnet project the farthest. Thus the bigger the magnet, the farther the "reach" of the magnetic lines of force in the center of the magnet. Thus a massive magnet projects it's field a great distance allowing for the stacking and stirring of multiple microplates in the magnetic field.

The High Volume version has the advantage of tumbling magnetic stainless steel stirrers in stacks standard microplates 12 high. Thus one hundred and eight 96 and 384 microplates and two hundred sixteen 1536 well microplates can be stirred at the same time. The total number of wells stirred simultaneously is 10,368 for 96 well plates, 41,472 for 384 well plates and 331,776 for 1536 well plates. The cost of our Magnetic Microplate Tumble Stirrer is less than $7,000 and the individual stirrers can be retailed from $0.07 to $0.15 each. Thus it is feasible to miniaturize many different applications that require stirring. The stirring action of tumbling is not significantly affected by the viscosity of the liquid as the tumble stirrer will stir viscous solutions as thick as pure glycerol with ease.

The High Speed version of the device uses alternating rows of opposite magnetic fields that, relative to the vessels, appear to move continuously in the same direction. Thus alternating vertical magnetic fields and powerful but short magnetic circuits with bent lines of flux are formed. The movement of an array of alternating rows of magnetic north and south poles in the same continuous direction causes the stirrers to produce a continuous tumbling end over end action in the opposite direction of the drive magnet movement. The stirrers tumble because the walls of the vessels or wells prevent their lateral movement and the opposite pole is attracted to the next row of magnets. Thus the stir devices stand up vertically, lay down and stand on the opposite end in a continuous rapid tumbling action that produces very rapid tumbling speeds and significant liquid and particulate movement and mixing. This continuous tumbling stirring action is also very mechanically vigorous as the magnetic circuit of the alternating north—south pole rows of magnetic fields is very strong even though the lines of flux do not project as far.

This design has the advantage of tumbling the stirrers very rapidly and in the same direction thus providing vigorous liquid mixing and vortex formation even at the top of deep well microplates.

Achieving a vigorous mixing action in deep well plates is difficult because of the height of the fluid column and the surface tension of the liquid and it's attraction to the walls of the wells. Thus the taller the fluid column and the more viscous the fluid the greater need for a vigorous stirring method to dissolve solids, suspend particulates or mix two liquids.

This same continuous tumbling action can also be produced by spinning a horizontal row of magnets whose magnetic field is vertically oriented. This same continuous tumbling action can also be produced by moving the vessels over stationary rows of alternating drive magnetic fields or by using stationary vessels and stationary vertically oriented electromagnets and synchronously changing the strength and polarity of magnetic fields in rows of electromagnets. Thus it can be seen that there are a variety of means to produce this same effect.

We have also developed simple dispensing systems that will efficiently place the various stir devices (discs, bars or dowels) into all the wells of a microplate (from the 6 well microplate to the 1536 well microplate) in a single step. Thus the technical process of placing stirrers in microplates for Magnetic Tumble Stirring is easy. Also the process of removing the stirrers is simple, just use a powerful magnet over the top of the microplate or a replicator with magnetic pins to extract the stirrers. Furthermore unlike the single 96 well microplate that a Hydra work station pipetter can mix at one time, the Magnetic Tumble Stirrer is able to mix 108 microplates simultaneously as the microplates can be stirred while in multilayered stacks. Furthermore the Hydra work station pipetter must wash each of the pipets between microplates to avoid contamination. Although pipetting the contents of wells up and down will provide adequate mixing, this is a very laborious operation and cumbersome process and can not be done in processes that require continuous mixing such as microbial culturing.

The Magnetic Tumble Stirrer costs under $7,000 and the stir discs, bars and dowels are very inexpensive (from $0.07 to $0.15 each). Furthermore the stirrers can be reclaimed, washed, sterilized and reused over and over again because they are made from stainless steel. Thus the setup cost of tumble stirring for a single 96 well microplate including stirrers is $71.53 compared to $2,635.00 for the Variomag and $30,000 for the Hydra pipetting work station.

It is also an object of this device to be small enough to fit inside standard culture incubators so that microbial cultures can be stirred while growing. The above mentioned High Volume version of the Magnetic Tumble Stirrer is 17" wide by 17" long by 7" high and thus will fit into the 18" wide door on most culture incubators. This model has space for 9 microplates on the surface and will stir plates stacked 12 high or 108 microplates.

It is also an object of this device to be made as large or as small to fit the application at hand.

It is also an object of this device to have a speed controller attached to the device so as to determine the speed or vigor of mixing.

Still further objects and advantages will become apparent from a consideration of the ensuing description and accompanying drawings.

ADDITIONAL SUMMARY

Figures 1A, 1B, 1C, 1D, 1E, 1F, 1G:
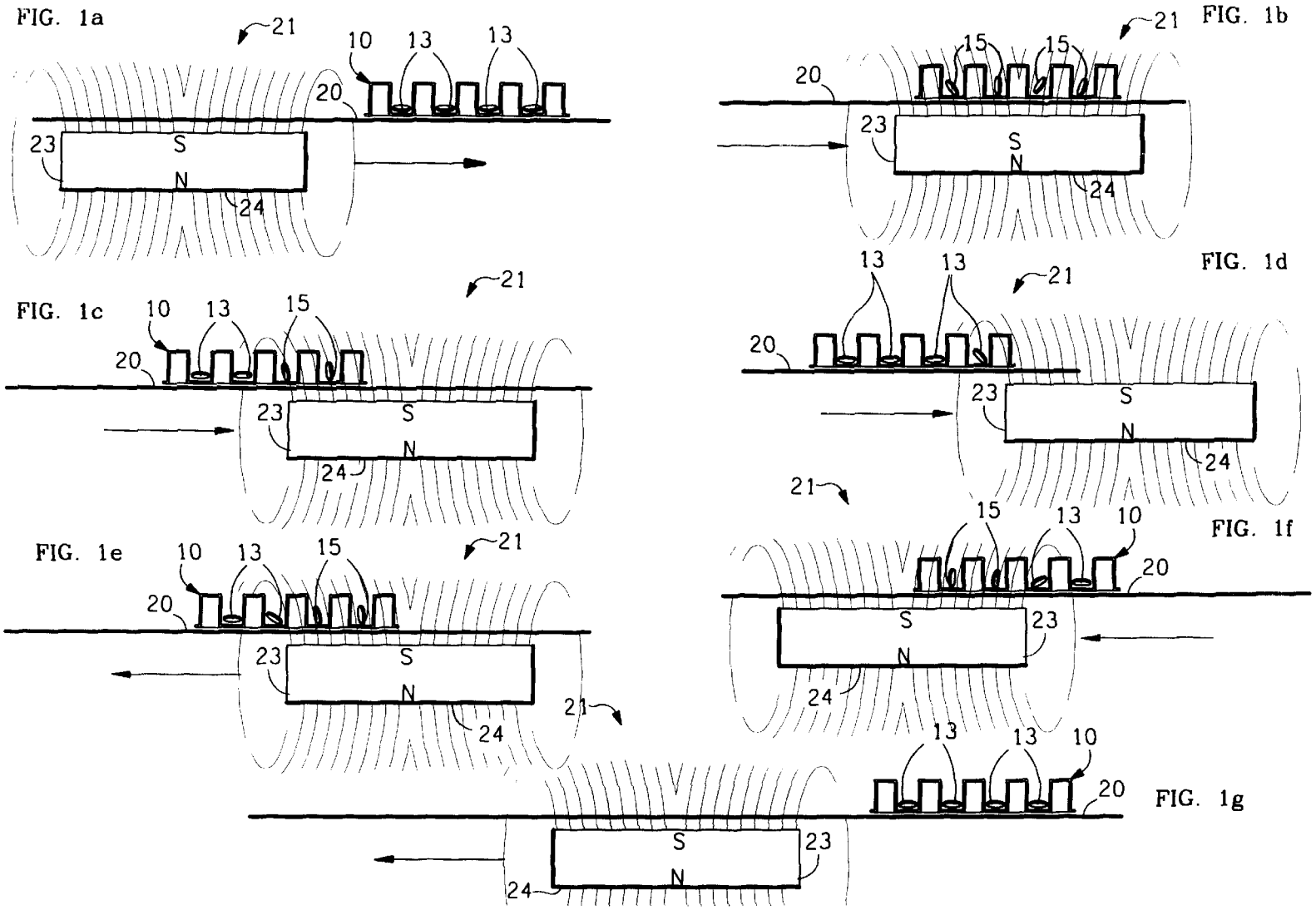
FIGS. 1*a*–1*g* illustrates reversing tumbling action of a stir disc in a microplate well on the High Volume (massive magnet) Version.

The invention provides a simple method, device and several machines for simultaneously stirring thousands of vessels or wells of microplates in a robust manner and with economy. This method uses the simple principle of magnetic stirrers aligning themselves to a vertical driving magnetic field placed beneath them and moving laterally or by moving the vessels over a stationary magnetic field or by spinning the drive magnets, or by using a modulating/reversing electromagnetic field to produce the moving effect. Each vessel contains a magnetic disc, bar, dowel or other shape (stirrers) which in it's magnetic attraction to the vertical driving magnetic field will cause it to move and align it's magnetic field as the opposite poles of the drive magnet and the stirrer attract each other.

The High Volume version of the invention uses a massive driving magnet that is moved back and fourth under the vessels which contain magnetic stirrers. The strength of the massive vertical magnetic field is projected a great distance allowing for the stacking of multiple microplates in the magnetic field. The attraction of the stirrers to the vertical driving magnetic field causes the stirrers to stand on end and tumble as the stir devices try to align to the opposite moving magnetic pole. The stirrers tumble because the walls of the vessels or friction with the vessel bottom prevents their lateral movement. The vertical orientation of the driving magnet magnetic field produces a strong magnetic coupling to the stirrers resulting in a robust vertical stirring action as the stirrers rise on one side as the magnet moves under them. After the stirrers reach the vertical they begin to fall on the other side until they are horizontal as the magnetic field passes beyond them. The drive magnet's direction is then reversed and the tumble cycle is reversed.

The High Speed version of the device uses a moving array of powerful magnets on a conveyor belt with alternating rows of north and south magnetic poles vertically aligned. Thus powerful alternating vertical magnetic fields and powerful magnetic circuits are formed. The movement of alternating rows of magnetic north and south poles causes the stirrers to produce a continuous tumbling end over end (vertical spinning) action in the opposite direction from the magnetic field movement. The stirrer devices tumble because the walls of the vessels or friction with the vessel bottom prevents their lateral movement and because the opposite pole is attracted to the next row of magnets. Thus the stir devices stand up vertically, lay down and stand on the opposite end in a continuous rapid spin tumbling action that produces very rapid tumbling speeds and significant liquid movement and mixing. This stirring action is also very mechanically vigorous as the magnetic circuit of the alternating north—south pole rows of magnetic fields is very strong even though the lines of flux do not project as far as a massive magnet.

Spinning Magnet version of the device spins long rows of horizontal magnets that have the magnetic field vertically aligned. Thus spinning a row of magnets causes a continuously changing of the orientation of the magnetic field thereby causing the stirrers to produce a continuous tumbling end over end (vertical spinning) action in the opposite direction from the spinning magnetic field movement. The stirrer devices tumble because the walls of the vessels or friction with the vessel bottom prevents their lateral movement and because the opposite pole is attracted to the next row of magnets. Thus the stir devices stand up vertically, lay down and stand on the opposite end in a continuous rapid spin tumbling action that produces very rapid tumbling speeds and significant liquid movement and mixing. This stirring action because the magnets in a row are more massive and the rows farther separated, produces a magnetic field with greater reach than the High Speed version. Consequently several layers of microplates can be stirred at once.

DESCRIPTION OF INVENTION

FIGS. 1*a, b, c* and *d,* illustrate how tumble stir discs (13) are moved and tumbled in the presence of the vertically aligned magnetic field (21) of a reversing moving drive magnet with the south pole up (23). As the drive magnet (23) moves, the discs (15) tumble as their magnetic north pole magnetically couples to the magnetic field (21) of the drive magnet's south pole (23). The whole tumbling process is reversed when the direction of the drive magnet (23) is reversed in FIG. 1*e, f* and *g*.

Figure 2B:
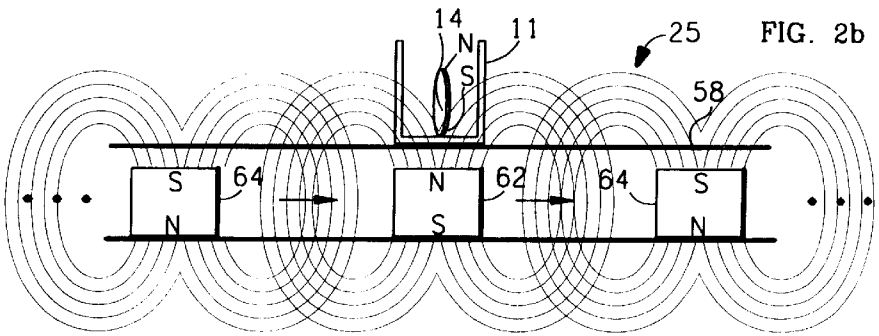
FIGS. 2*a*–2*e* illustrates continuous tumbling action of a stir disc in a microplate well on the High Speed (conveyor belt)Version.
Figure 2D:
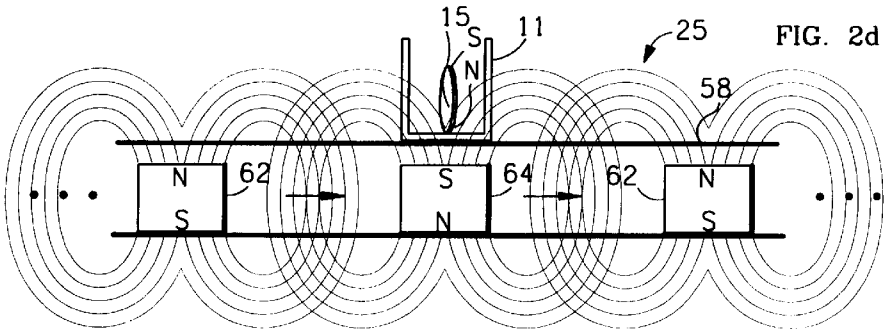
Figure 2E:
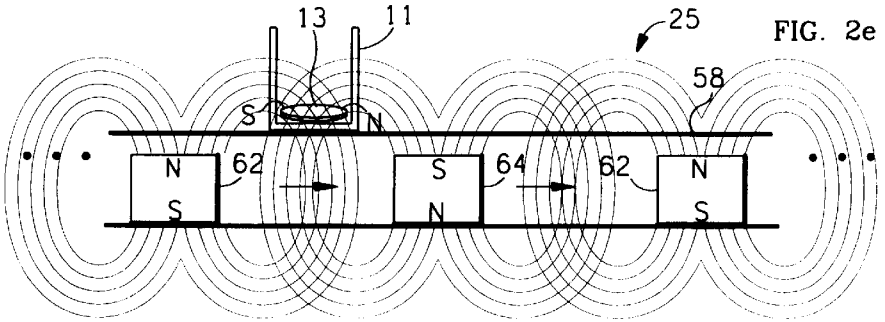
Figure 2A:
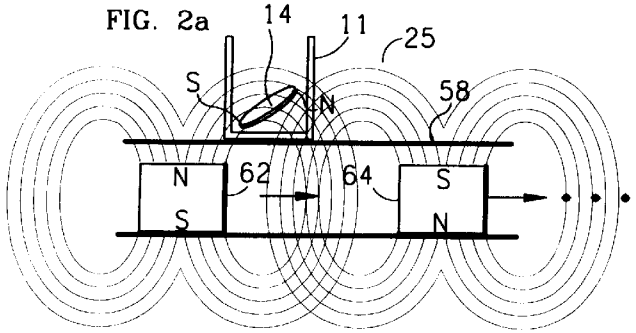
Figure 2C:
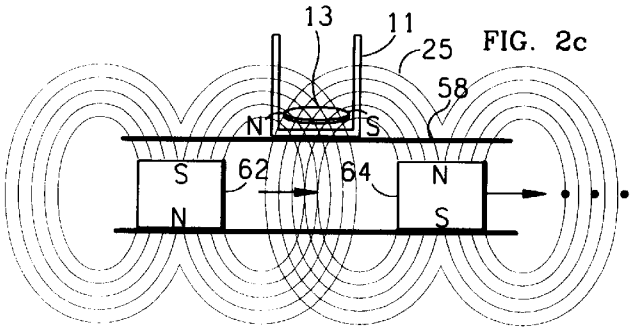

FIGS. 2*a, b, c, d,* and *e* illustrate how tumble stir discs (13) are moved and tumbled continuously in the same direction in the presence of vertically aligned alternating north south drive magnetic field. As the drive magnetic array (62 and 64) moves, the discs (14) tumble as their magnetic south pole magnetically couples to the magnetic circuit (25) between drive magnet 62 and drive magnet 64 producing a continuous tumbling action in the same direction as the magnetic circuit moves laterally to the stir disc.

Figure 3B:
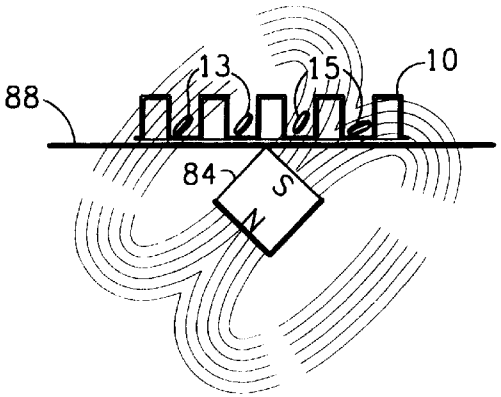
FIGS. 3*a*–3*d* illustrates continuous tumbling action of a stir disc in a microplate well on the spinning magnetic field version.
Figure 3D:
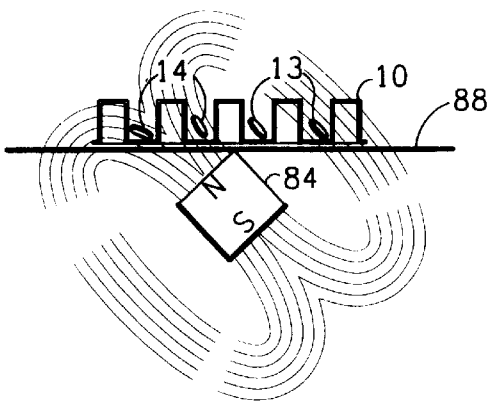
Figure 3A:
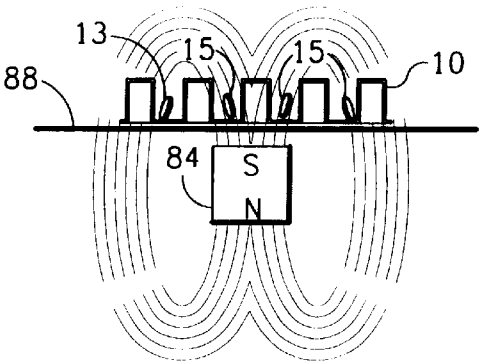
Figure 3C:
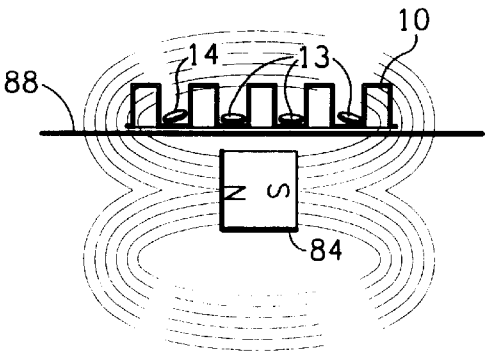

FIGS. 3*a, b, c* and *d* illustrate how tumble stir discs (13) are moved and tumbled continuously in the same direction in the presence of vertically oriented drive magnets (84) that spin around the horizontal axis. As the drive magnet (84) spin, the discs (14 and 15) tumble as their magnetic poles couple to the magnetic circuit (25) between the drive magnets (84) producing a continuous tumbling action in the opposite direction.

Figure 4:
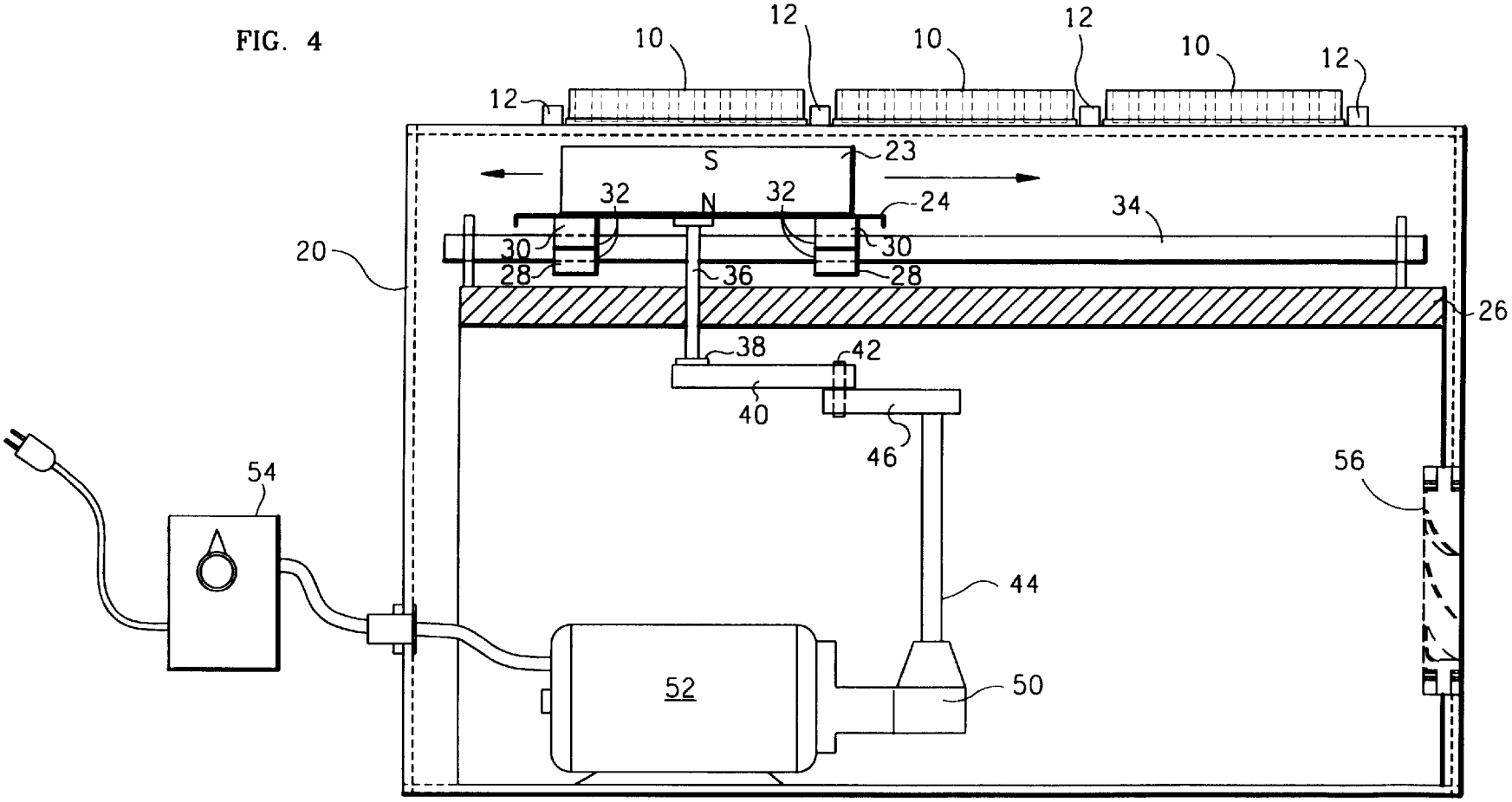
FIG. 4 illustrates an exposed side view of the High Volume form of the invention.

FIG. 4 illustrates the side view of the High Volume embodiment of the invention with microplates (10) setting on a microplate tray (12) on top of an aluminum chassis (20). The exposed part of FIG. 4 illustrates the presences of a 1" thick by 3.5" wide by 15" long drive magnet (23) with the south pole oriented up. The drive magnet is made to move back and forth inside the chassis by conversion of rotary motion to linear motion drive. The drive magnet is attached to a steel plate (24) via it's magnetic field and the steel plate is attached via pin (36) to bearing (38) and pivot arm (40). A pivot arm bearing (42) links the pivot arm (40) to drive arm (46) which is solidly fixed to the gear box drive shaft (44). When the Motor (52) turns, the gear box drive shaft (44) also turns and through the pivot arm (40) and drive arm (46) connections, it causes the drive magnet to move back and forth on four slide rail bearings (32) that are attached to the bottom of the steel plate (24). The slide rail bearings roll up and down a slide rail (34) that is held in place by an upper slide rail bracket (30) and a lower slide rail bracket (28) that in turn is attached to a slide rail support (26). The motor (52) is connected to a variable speed controller so the speed of the magnet's movement can be controlled. A small cooling fan (56) is present to cool the motor.

Figure 5:
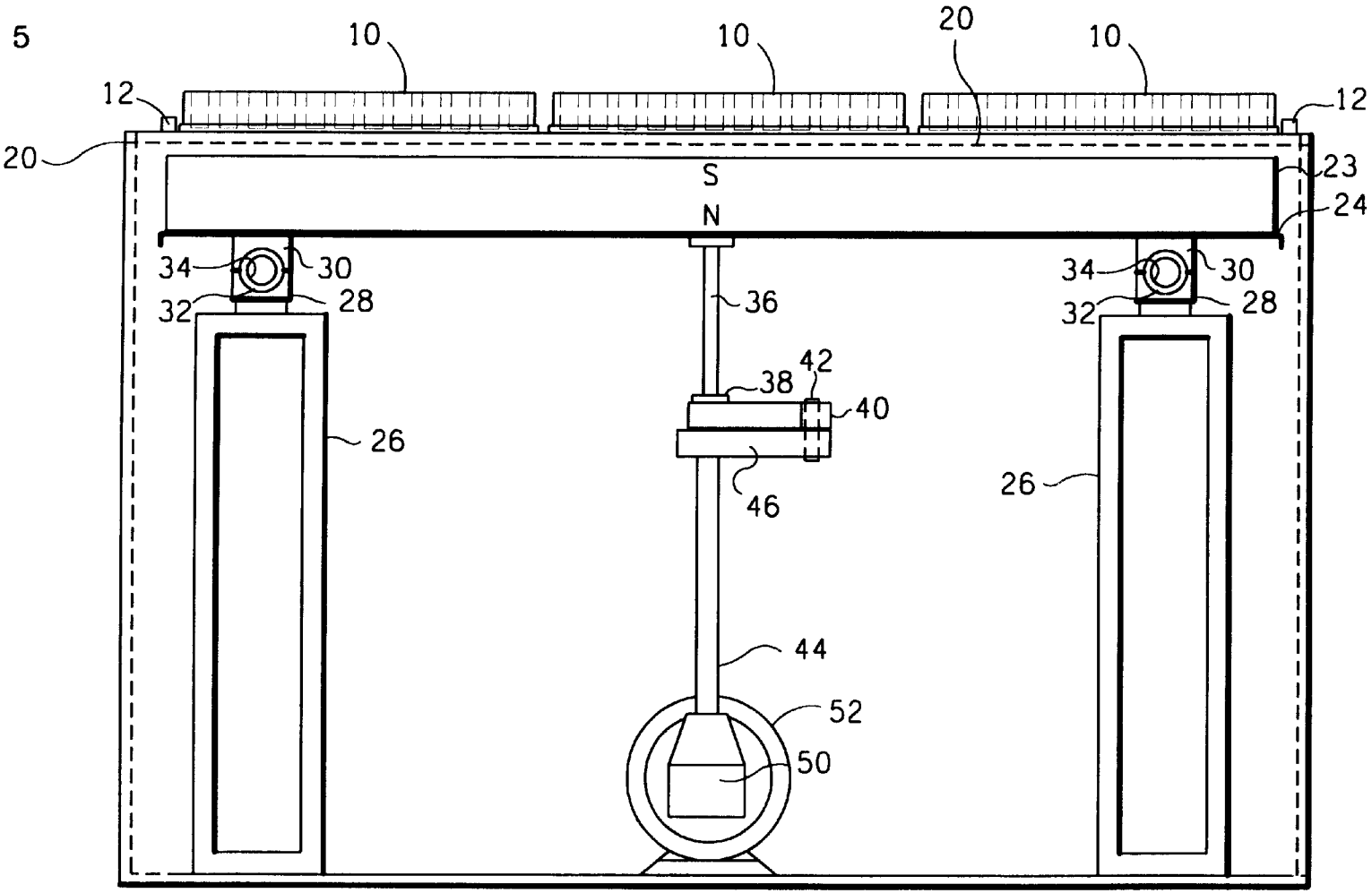
FIG. 5 illustrates an exposed end view of the High Volume form of the invention.

FIG. 5 illustrates the end view of the High Volume embodiment of the invention with microplates (10) setting on a microplate tray (12) on top of an aluminum chassis (20). The exposed part of FIG. 5 illustrates the presences of a 1" thick by 3.5" wide by 15" long magnet (23) with the south pole facing up. The magnet is made to move back and forth inside the chassis by conversion of rotary motion to linear motion drive. The magnet is attached to a steel plate (24) via it's magnetic field and the steel plate is attached via pin (36) to bearing (38) and pivot arm (40). A pivot arm bearing (42) links the pivot arm (40) to drive arm (46) which is solidly fixed to the gear box drive shaft (44). When the Motor (52) turns, the gear box drive shaft (44) also turns and through the pivot arm (40) and drive arm (46) connections, it causes the magnet to move back and forth on four slide rail bearings (32) that are attached to the bottom of the steel plate (24). The slide rail bearings roll up and down a slide rail (34) that is held in place by an upper slide rail bracket (30) and a lower slide rail bracket (28) that in turn is attached to a slide rail support (26). The motor (52) is attached to a variable speed controller so the speed of the magnet's movement can be controlled. A small cooling fan (56) is present to cool the motor.

Figure 6:
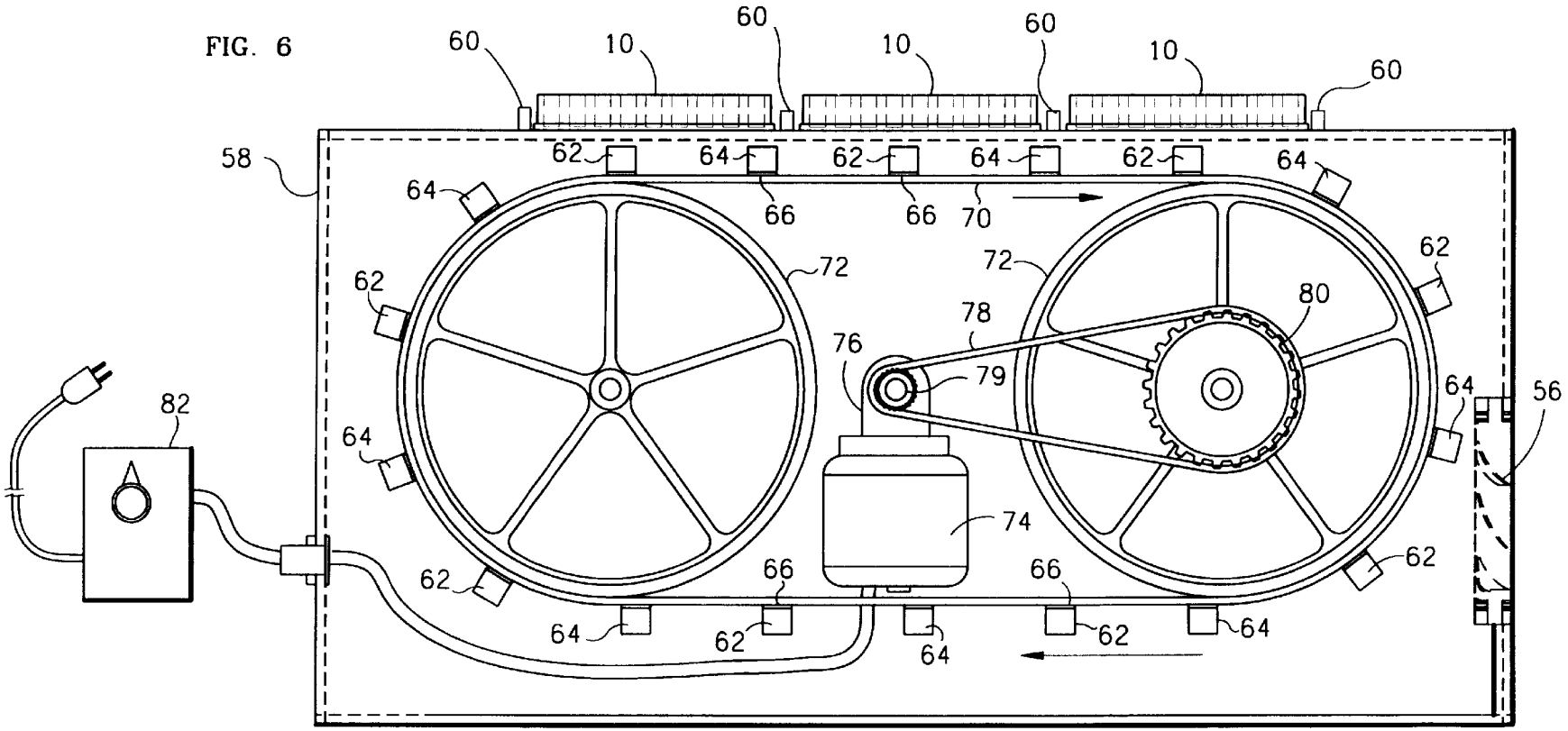
FIG. 6 illustrates an exposed side view of the High Speed form of the invention.

FIG. 6 illustrates the High Speed embodiment of the invention with microplates (10) that are held stationary by a microplate register (60) which is attached to the aluminum chassis (58). The exposed part of FIG. 6 illustrates the presence of a conveyor belt (70) with rows of north pole up drive magnets (62) alternating with rows of south pole up drive magnets (64). The conveyor belt (70) studded with the alternating rows drive magnets (62 & 64) is driven by the motor (74) turning the gear box (76) which turns the drive pulley (79) which turns the drive belt (78) and the roller (72) and the conveyor belt (70) with the array of alternating rows vertically aligned drive magnets (62 & 64).

Figure 7:
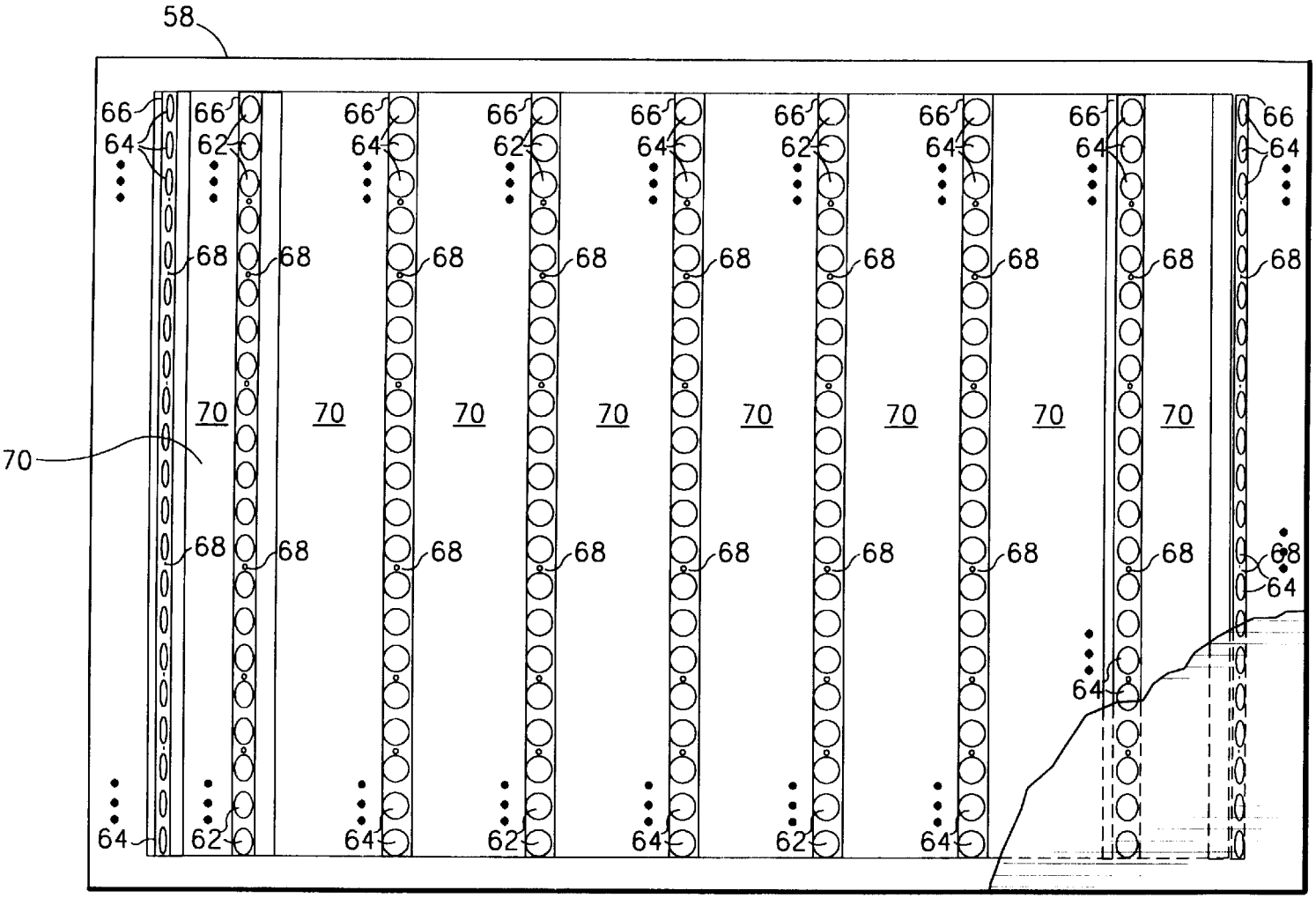
FIG. 7 illustrates an exposed top view of the High Speed form of the invention.

FIG. 7 illustrates the top exposed view of the High Speed embodiment with alternating rows of drive magnets (62 &64) attached to the conveyor belt (70) by rivets (68) through the steel magnet strip assembly (66).

Figure 8:
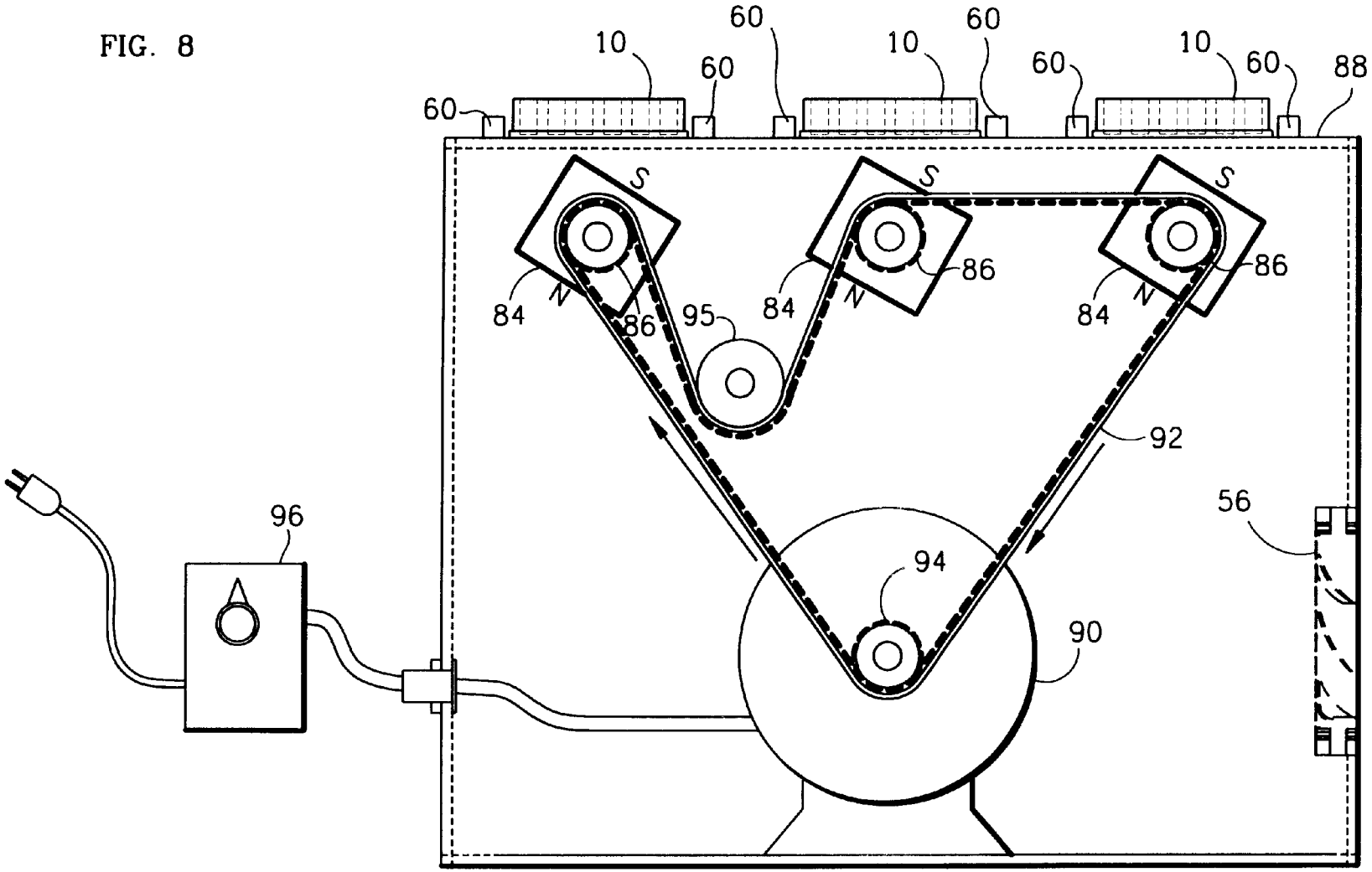
FIG. 8 illustrates an exposed side view of the Spinning Magnetic field form of the invention.

FIG. 8 illustrates the side view of the Spinning Magnet embodiment of the invention with microplates (10) that are held stationary by a microplate register (60) which is attached to the aluminum chassis (88). The exposed part of FIG. 8 illustrates the ends of three long rows of spinning drive magnets (84). The drive belt (92) which transmits rotary motion from the motor (90) to pulleys (86) on the end of each of the three drive spinning magnets (84). The tension on the drive belt (92) is adjusted using an idler pulley (95). The motor speed is controlled by a variable electrical control (96).

Conclusions, Ramifications, and Scope

Accordingly, it can be seen that magnetic tumble stirring provides a very simple, economical and robust method of stirring thousands of vessels or microplate wells simultaneously. The size and shape of the vessel or well to be stirred is easily accommodated with adaptable size and shaped stirrers or using multiple stirrers/vessel. Straight forward methods of adding and removing the stirrers from the wells have been developed to facilitate the process. The speed of the stirring action is completely operator controlled or can be linked to a computer for complex procedures. The vigor of the stirring action can be significantly increased using the High Speed and Spinning Magnet versions's continuous tumbling action to create vortexes which are ideal for stirring liquids in deep well microplates. Liquids with dissimilar viscosities may be mixed at the same time within different wells of the same microplate without the stirrers being "thrown out of sync". These elements are key in the miniaturization of processes that require mixing.

Although the description above contains three versions, these should not be construed as limiting the scope of the invention but as merely providing illustrations of some of the presently preferred embodiments of this invention. Various other embodiments and ramifications are possible within it's scope. For example, electromagnetic drive magnets may be vertically spun on their horizontal magnetic axis and moved laterally to produce a reversing magnetic field, the vessels maybe moved instead of the drive magnets, electromagnetic fields may be created and reversed in a manner to simulate a moving or reversing drive magnet, electromagnets maybe pulsed on and off, the dimensions of the device, the number of reaction chambers that may be accommodated, the size, strength, number and location of the magnets used may be varied to produce different stirring effects depending upon the size and shape of the wells, the size, shape, number and magnetic orientation of the magnetic stirrers. Furthermore by staggering the relative locations of drive magnets between the rows of north and south pole alignment of small magnets in the high speed version you can cause the stirrers to deviate from a straight line tumble to a zig zag 45 degree tumble in the well. Thus the scope of the invention should be determined by the appended claims and their legal equivalents, rather than by the examples given.

REFERENCE NUMERALS IN DRAWINGS

10 microplates
11 microplate well
12 microplate trays
13 tumble stir disc
14 tumble stir disc north pole up
15 tumble stir disc south pole up
16 tumble stir bar
17 tumble stir bar north pole up
18 tumble stir bar south pole up
19 tumble stir dowel
20 aluminum chassis high volume version
21 magnetic field
22 drive magnet north pole up
23 drive magnet south pole up
24 steel plate
25 magnetic circuit
26 slide rail support
28 slide rail bracket—lower
30 slide rail bracket—upper
32 slide rail bearing
34 slide rail
36 magnet plate pin
38 magnet plate pin bearing
40 pivot arm
42 pivot arm bearing
44 gear box drive shaft
46 drive arm
50 gear box
52 dc motor High Volume Version
54 variable speed controller High Volume Version
56 cooling fan
58 aluminum chasis High Speed Version
60 microplate register
62 drive magnet north pole up
64 drive magnet south pole up
66 steel magnet strip assembly
68 rivet
70 conveyor belt
72 roller
74 motor high speed version
76 gear box
78 drive belt
79 drive pulley
80 pulley
82 variable speed controller High Speed Version
84 clockwise spinning drive magnet
86 pulley on spinning magnet
88 aluminum chassis spinning magnet version
90 motor spinning magnet version
92 drive belt spinning magnet version
94 drive pulley spinning magnet version
95 idler pulley
96 variable speed controller spinning magnet Thus having described our invention we claim:

1. A method of mixing the contents of each of a two-dimensional array of vessels, each vessel having a vertical axis as defined when the vessel is disposed for the mixing of said contents, the method comprising the steps of:

(a) placing magnetic stirrers within said vessels; and (b) when the vessels are disposed for the mixing of said contents, rotating a permanent magnet about a non-vertical axis of rotation that is so disposed adjacent the array that said rotation of the magnet provides magnetic flux lines that rotate through 360 degrees within a non-horizontal plane within each of the vessels to thereby cause the magnetic stirrers therein to tumble in at least one direction that is other than about the vertical axis of each vessel;

whereby the contents of each vessel containing a said magnetic stirrer are mixed by the tumbling of said magnetic stirrer.

2. A method according to claim 1, wherein said at least one direction is along the vertical axis of each vessel.

3. A method according to claim 1, wherein the axis of rotation is horizontal.

4. A method according to claim 1, wherein the axis of rotation is beneath the array.

5. A method according to claim 1, wherein the array is elongated in a direction parallel to the axis of rotation and the permanent magnet is elongated in said parallel direction.

6. A method according to claim 1, wherein the array of vessels are embodied as wells in a microplate.

7. A system for mixing the contents of each of a two-dimensional array of vessels, each vessel having a vertical axis as defined when the vessel is disposed for the mixing of said contents, the system comprising:

means for receiving an array of vessels in a disposition for the mixing of said contents;

a permanent magnet disposed in relation to the receiving means for rotation about a non-vertical axis of rotation that is so disposed adjacent the array that said rotation of the magnet provides magnetic flux lines that rotate through 360 degrees within a non-horizontal plane within each of the vessels to thereby cause magnetic stirrers therein to tumble in at least one direction that is other than about the vertical axis of each vessel; and means for so rotating the permanent magnet;

whereby the contents of each vessel containing a said magnetic stirrer are mixed by the tumbling of said magnetic stirrer.

8. A system according to claim 7, wherein said at least one direction is along the vertical axis of each vessel.

9. A system according to claim 7, wherein the axis of rotation is horizontal.

10. A system according to claim 7, wherein the axis of rotation is beneath the array.

11. A system according to claim 7, wherein the array is elongated in a direction parallel to the axis of rotation and the permanent magnet is elongated in said parallel direction.

12. A system according to claim 7, wherein the array of vessels are embodied as wells in a microplate.

* * * * *